US012685363B2

(12) United States Patent
Wax et al.

(10) Patent No.: US 12,685,363 B2
(45) Date of Patent: Jul. 21, 2026

(54) COLLAPSIBLE HELMET AND CORRESPONDING PRODUCTION METHOD

(71) Applicant: MONOPRO LTD., Kfar Saba (IL)

(72) Inventors: Omer Wax, Raanana (IL); Menachem Guttman, Raanana (IL); Benjamin Gal, Raanana (IL)

(73) Assignee: MONOPRO LTD., Kfar Saba (IL)

( * ) Notice: Subject to any disclaimer, the term of this patent is extended or adjusted under 35 U.S.C. 154(b) by 0 days.

(21) Appl. No.: 18/868,763

(22) PCT Filed: May 10, 2023

(86) PCT No.: PCT/IB2023/054832
§ 371 (c)(1),
(2) Date: Nov. 24, 2024

(87) PCT Pub. No.: WO2023/233224
PCT Pub. Date: Dec. 7, 2023

(65) Prior Publication Data

US 2025/0344801 A1 Nov. 13, 2025

(30) Foreign Application Priority Data

May 31, 2022 (IL) ..... 293498

(51) Int. Cl.

| | |
|---|---|
| ***A42B 3/32*** | (2006.01) |
| ***A42B 3/06*** | (2006.01) |
| ***A42B 3/08*** | (2006.01) |

(52) U.S. Cl.
CPC ..... *A42B 3/322* (2013.01); *A42B 3/063* (2013.01); *A42B 3/08* (2013.01)

(58) Field of Classification Search
CPC ..... A42B 3/322; A42B 3/063; A43B 3/32
USPC ..... 2/411
See application file for complete search history.

(56) References Cited

U.S. PATENT DOCUMENTS

| | | | | |
|---|---|---|---|---|
| 2006/0096011 | A1* | 5/2006 | Dennis | A42B 3/145 2/421 |
| 2019/0142100 | A1* | 5/2019 | Shiffer | G09F 21/02 2/417 |

* cited by examiner

*Primary Examiner* — Timothy K Trieu
(74) *Attorney, Agent, or Firm* — Rivka Friedman

(57) ABSTRACT

A collapsible helmet is formed as an arcuate layered structure openable into a honeycomb protective configuration. The arcuate layered structure is formed from a number of arcuate segments each covering only part of the helmet. Each segment is oriented so that an extensional cell direction of the honeycomb structure is radial for a middle-region. The arcuate layered structure is preferably bounded by arcuate end plates which engage with each other when the helmet is open to form a rigid loop encircling a bottom edge of the helmet.

12 Claims, 10 Drawing Sheets

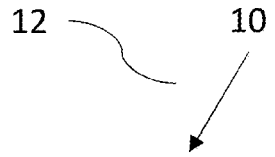
FIG. 2D
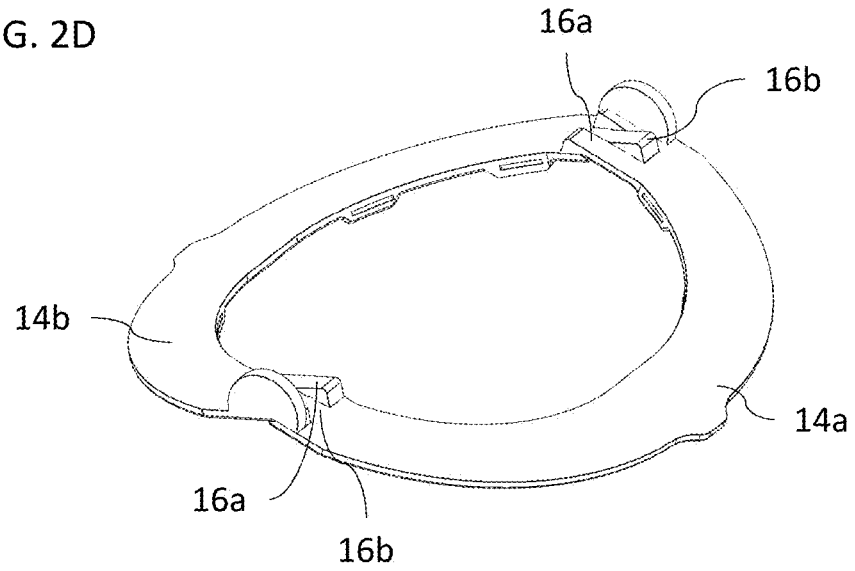
FIG. 2E
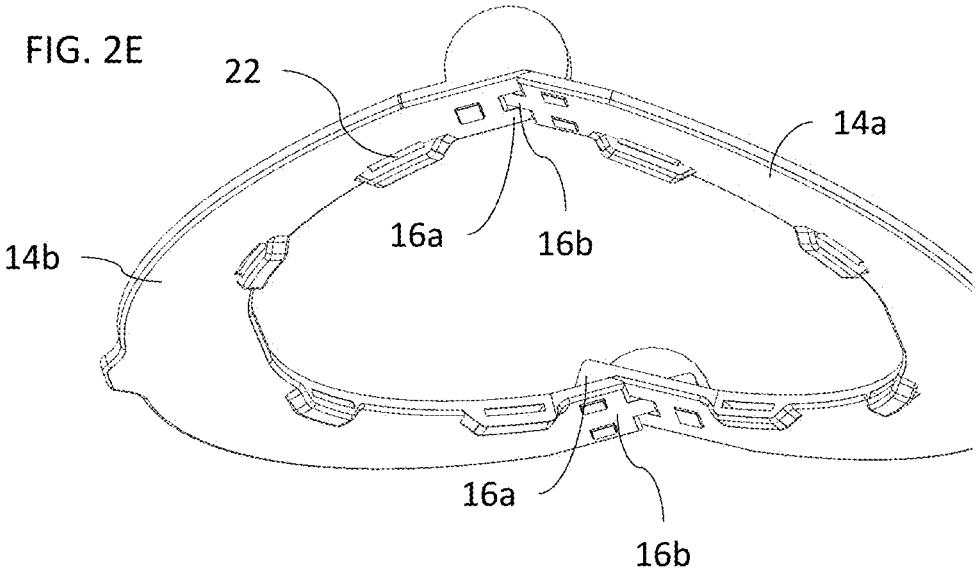

COLLAPSIBLE HELMET AND CORRESPONDING PRODUCTION METHOD

FIELD AND BACKGROUND OF THE INVENTION

The present invention relates to protective headwear and, in particular, it concerns a collapsible helmet employing a honeycomb structure.

The use of a protective helmet while riding a bicycle, electric scooter or other light personal transport solutions greatly reduces the risks of serious head injury. The use of helmets is therefore encouraged, and in many countries, legally required, when operating such devices.

Particularly in urban areas, there is a growing trend towards the use of "shared micro-mobility" solutions, in which individuals can use any one of a fleet of personal vehicles which are spread around a city and use the vehicle to travel to another location within the city, typically without needing to return it to the first location. Such solutions are convenient, cost efficient and time efficient, reduce traffic congestion and reduce carbon emissions.

It has been found, however, that due to the bulkiness of a standard protective helmet, many people are unwilling to carry a helmet around with them all day for use when they want to employ a shared micro-mobility solution. This results in reduced usage of the micro-mobility solutions and/or tempts people to use the micro-mobility solutions without the protection of a helmet, both of which are undesirable.

It has been proposed to make helmets more accessible to users of micro-mobility solutions by providing collapsible helmets which are compact to carry when not in use, and which can be deployed to provide head protection when needed. In some cases, the collapsed form is sufficiently compact to be suitable for sale from a vending machine, making it feasible to greatly increase accessibility of helmets to users of shared micro-mobility solutions.

One particularly promising candidate for use in a collapsible helmet is a flexible honeycomb structure. A "honeycomb structure" in this context refers to a structure formed from layers of a flexible material that are attached along spaced-apart lines, and the lines of attachment are interspaced (staggered) between successive layers, so that the structure assumes a collapsed (flattened) form and a deployed form in which non-attached regions open up into a cellular structure with staggered cells between layers. The honeycomb structure is effective for absorbing impact energy through progressive crumpling or other deformation of the cell walls.

SUMMARY OF THE INVENTION

The present invention is a collapsible helmet employing a honeycomb structure, and a corresponding production method.

According to the teachings of an embodiment of the present invention there is provided, a collapsible helmet deployable for protecting a head of a user, the helmet comprising: an arcuate layered structure assuming a collapsed state and openable into a honeycomb protective configuration for encompassing at least an upper part of the head, the arcuate layered structure spanning an angular range from a first end to a second end, the arcuate layered structure being formed at least in part from a plurality of arcuate segments each having an angular span less than the angular range, each segment having a plurality of layers, each of the layers being joined to adjacent layers along lines of attachment, the lines of attachment being staggered between successive of the layers so as to define, when opened, a honeycomb structure with an extensional cell direction, the extensional cell direction being a radial direction for a mid-region of each of the arcuate segments, the arcuate layered structure including at least two of the arcuate segments deployed sequentially between the first end and the second end so that the extensional cell directions approximate to radial directions of the arcuate layered structure across the angular range.

According to a further feature of an embodiment of the present invention, the arcuate layered structure has a helmet thickness in the radial direction, and wherein adjacent of the arcuate segments are formed with complementary overlap regions, each of the overlap regions having a thickness less than the helmet thickness, the complementary overlap regions being deployed in overlapping relation so as to provide a combined thickness greater than the thickness of each of the overlap regions.

According to a further feature of an embodiment of the present invention, the thickness of each of the complementary overlap regions is tapered.

According to a further feature of an embodiment of the present invention, the arcuate layered structure comprises a first plurality of the arcuate segments spanning the angular range from the first end to the second end and a second plurality of the arcuate segments spanning the angular range from the first end to the second end, the second plurality of the arcuate segments being bonded to the first plurality of the arcuate segments such that each of the first and second pluralities of the arcuate segments provides a part of an overall width of the honeycomb protective configuration, and wherein the overlap regions of the first plurality of the arcuate segments do not coincide with the overlap regions of the second plurality of the arcuate segments.

According to a further feature of an embodiment of the present invention, there is also provided a pair of arcuate end plates bonded to outer surfaces of the arcuate layered structure, opposite ends of each of the arcuate end plates carrying complementary parts of an engagement configuration, wherein, in a collapsed stated of the helmet, the arcuate end plates are brought together with the arcuate layered structure between them, and wherein, when the honeycomb structure is open, the engagement configurations at ends of the arcuate end plates engage so that the arcuate end plates form a rigid loop encircling a bottom edge of the helmet.

According to a further feature of an embodiment of the present invention, in the rigid loop, the arcuate end plates form a locking angle between them greater than 180 degrees around which the honeycomb structure is stretched.

According to a further feature of an embodiment of the present invention, the engagement configurations are configured to allow engagement of the complementary parts of the engagement configurations when the arcuate end plates are temporarily brought to an engagement angle which is greater than the locking angle, and wherein resilient tension in the honeycomb structure biases the arcuate end plates to return from the engagement angle to the locking angle.

There is also provided according to the teachings of an embodiment of the present invention, a method for producing the aforementioned collapsible helmet, including the steps of: (a) providing a sheet of a laminate structure formed from layers joined to adjacent layers along staggered lines of attachment to as to define, when opened, a honeycomb structure with parallel extensional cell directions; (b) cutting from the sheet a plurality of arcuate segments, each of the arcuate segments being oriented relative to the uniform extensional cell direction so that the extensional cell direction is radial relative to a mid-region of the arcuate segment; and (c) assembling the arcuate segments in juxtaposed relation to form an arcuate layered structure in which the extensional cell directions of the arcuate segments are non-parallel.

There is also provided according to the teachings of an embodiment of the present invention, a collapsible helmet deployable for protecting a head of a user, the helmet comprising: (a) an arcuate layered structure openable into a honeycomb protective configuration for encompassing at least an upper part of the head, the arcuate layered structure being formed from layers joined to adjacent layers along staggered lines of attachment so as to define, when opened, a honeycomb structure; and (b) a pair of arcuate end plates bonded to outer surfaces of the arcuate layered structure, opposite ends of each of the arcuate end plates carrying complementary parts of an engagement configuration, wherein, in a collapsed stated of the helmet, the arcuate end plates are brought together with the arcuate layered structure between them, and wherein, when the honeycomb structure is open, the engagement configurations at ends of the arcuate end plates engage so that the arcuate end plates form a rigid loop encircling a bottom edge of the helmet.

According to a further feature of an embodiment of the present invention, in the rigid loop, the arcuate end plates form a locking angle between them greater than 180 degrees around which the honeycomb structure is stretched.

According to a further feature of an embodiment of the present invention, the engagement configurations are configured to allow engagement of the complementary parts of the engagement configurations when the arcuate end plates are temporarily brought to an engagement angle which is greater than the locking angle, and wherein resilient tension in the honeycomb structure biases the arcuate end plates to return from the engagement angle to the locking angle.

There is also provided according to the teachings of an embodiment of the present invention, a collapsible helmet deployable for protecting a head of a user, the helmet comprising: (a) a protective structure deployable as a dome for fitting to an upper part of the head of the user, the protective structure having strap guides located at regions of the dome corresponding to a right temple region, a left temple region, and at least one nape region; and (b) a strap harness configuration comprising: (i) a first strap portion extending from a first part of a chin buckle via the right temple strap guide, and traversing at least part of the dome of the protective structure, (ii) a second strap portion extending from a second part of a chin buckle via the left temple strap guide, and traversing at least part of the dome of the protective structure, (iii) a rear retainer strap arrangement interconnected with the first strap portion between the first part of the chin buckle and the right temple strap guide, interconnected with the second strap portion between the second part of the chin buckle and the left temple strap guide and deployed to extend around a nape of a neck of the user, and (iv) at least one rear tether, attached to or integrated with at least one of the first and second strap portions, extending from the dome via the at least one nape region strap guide and interconnected with the rear retainer strap arrangement.

According to a further feature of an embodiment of the present invention, the at least one rear tether is implemented as a first tether which is a continuation of the first strap portion and extends via a left strap guide of the at least one nape region strap guide, and a second tether which is a continuation of the second strap portion and extends via a right strap guide of the at least one nape region strap guide, the first tether and the second tether each being interconnected with the rear retainer strap arrangement.

According to a further feature of an embodiment of the present invention, the first strap portion, the first tether, the second tether and the second strap portion are parts of a single continuous strap.

According to a further feature of an embodiment of the present invention, there is also provided a clip deployed to clip together the first strap portion and the second strap portion at a region of overlap within the dome.

According to a further feature of an embodiment of the present invention, the strap harness configuration is deployed internally to the dome of the protective structure.

There is also provided according to the teachings of an embodiment of the present invention, a collapsible helmet deployable for protecting a head of a user, the helmet comprising: an arcuate layered structure openable into a honeycomb protective configuration for encompassing at least an upper part of the head, the arcuate layered structure being formed from layers joined to adjacent layers along staggered lines of attachment so as to define, when opened, a honeycomb structure, wherein the staggered lines of attachment are non-straight lines.

BRIEF DESCRIPTION OF THE DRAWINGS

The invention is herein described, by way of example only, with reference to the accompanying drawings, wherein:

FIGS. 2A-2E are isometric views of a pair of arcuate end plates from the collapsible helmet of FIGS. 1A and 1B, shown without other components of the helmet, illustrating a sequence of positions during opening of the helmet and interlocking of the end plates to form a closed loop support structure;

DESCRIPTION OF THE PREFERRED EMBODIMENTS

The present invention is a collapsible helmet employing a honeycomb structure, and a corresponding production method.

The principles and operation of helmets and methods according to the present invention may be better understood with reference to the drawings and the accompanying description.

By way of introduction, while a honeycomb structure is a promising component for implementing a collapsible protective helmet, there are a number of practical obstacles which limit its ability to satisfy the mechanical requirements for a protective helmet and/or which complicate the manufacture of such a helmet. The present invention includes a number of different aspects, each of which addresses one or more of these limitations and/or provides various additional advantageous properties for such a helmet. The various aspects of the invention are generally compatible to be combined in synergy, except where otherwise stated, while each is also considered to be of patentable significance and practical utility in its own right.

Specifically, a first aspect of the present invention relates to provision of a support structure which provides a rigid loop for the lower edge of the helmet in the deployed state, thereby enhancing the structural stability of the helmet. A second aspect of the present invention relates to a strap arrangement which is particularly effective for maintaining a collapsible helmet correctly positioned on the head of a user during use. A third aspect of the present invention relates to use of a plurality of honeycomb segments with differing extensional directions in order to provide the required mechanical properties for the helmet, and a corresponding manufacturing technique. Additional aspects of the present invention relate to modifications of the honeycomb structure itself to allow modification of its mechanical properties. Each of these aspects will now be addressed individually.

Closed Loop Support Structure

Figure 1A:
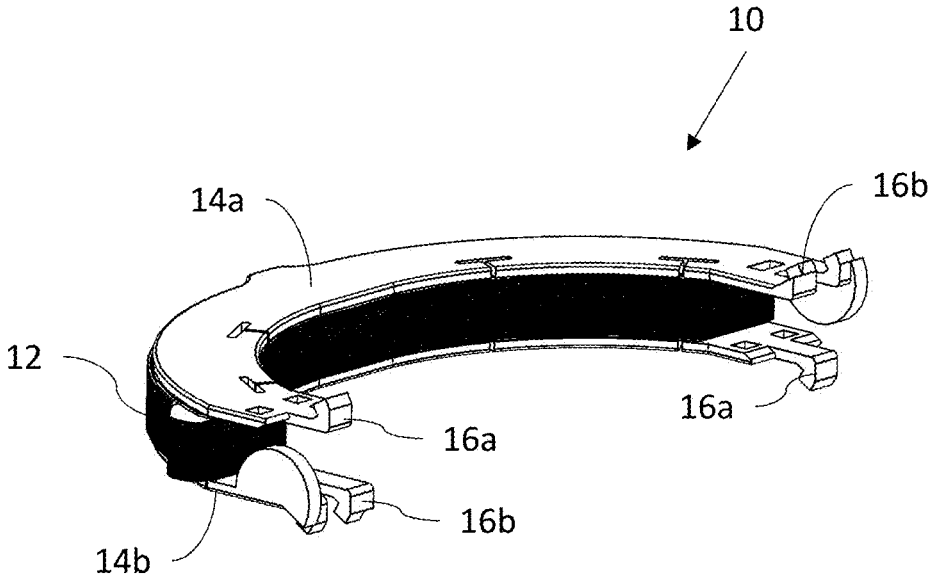
FIGS. 1A and 1B are isometric views of a collapsible helmet, constructed and operative according to the teachings of an embodiment of the present invention, in a collapsed state and a deployed state, respectively.
Figure 1B:
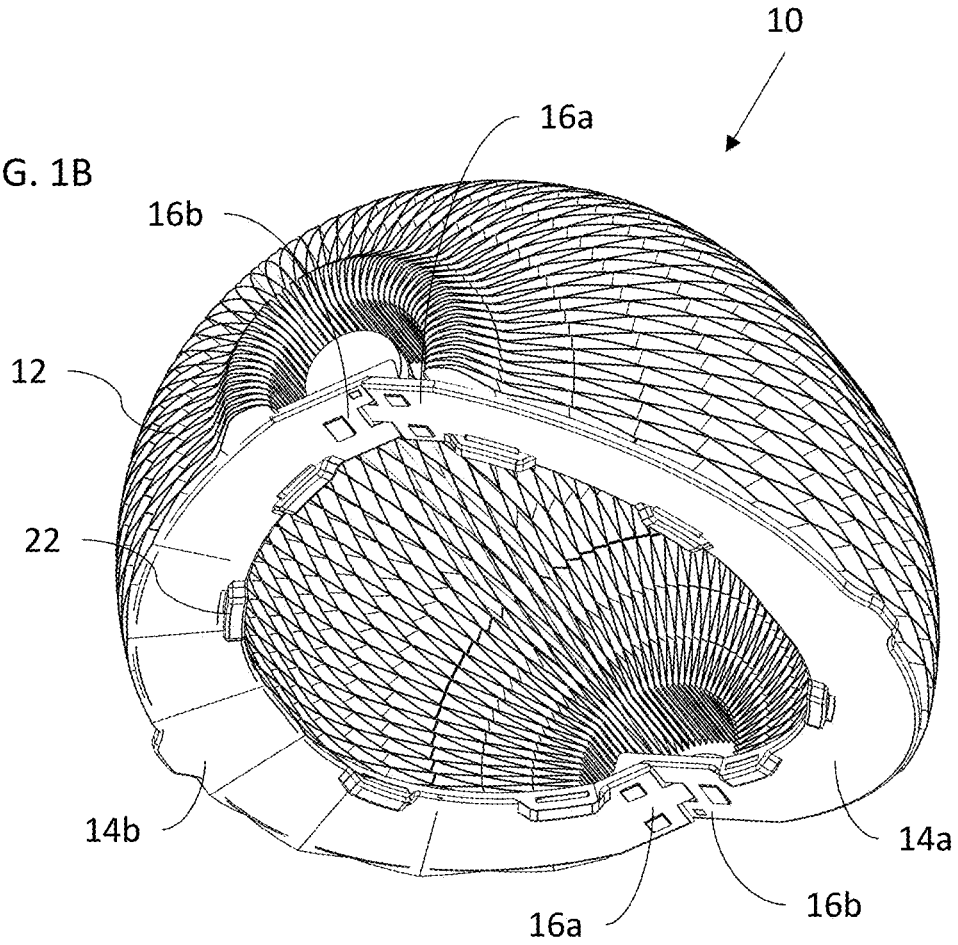

Referring now to the drawings, FIGS. 1A and 1B illustrate a collapsible helmet, generally designated 10, constructed and operative according to the teachings of an embodiment of the present invention, shown, respectively, in a collapsed state and a deployed state for protecting a head of a user. In general terms, helmet 10 is formed from an arcuate layered structure 12 openable into a honeycomb protective configuration for encompassing at least an upper part of the head. The arcuate layered structure 12 is formed from layers joined to adjacent layers along staggered lines of attachment so as to define, when opened, a honeycomb structure. A pair of arcuate end plates 14*a* and 14*b* are bonded to outer surfaces of arcuate layered structure 12, so that, in the collapsed stated of the helmet, arcuate end plates 14*a* and 14*b* are brought together with the arcuate layered structure sandwiched between them, as shown in FIG. 1A. This compact configuration is suitable for compact storage and transportation, for example, inside a briefcase or backpack of the user, and/or can be packaged for dispensing via an automated dispensing or vending machine. Opposite ends of each of the arcuate end plates 14*a* and 14*b* carry complementary parts 16*a* and 16*b* of an engagement configuration which, when the honeycomb structure is open, engage with each other so that arcuate end plates 14*a* and 14*b* together form a rigid loop encircling a bottom edge of the helmet, as seen in FIG. 1B.

Provision of a rigid loop encircling a bottom edge of the helmet addresses a number of issues that would otherwise limit the effectiveness of a collapsible honeycomb protective structure, providing additional support to the extremities of the honeycomb, which might otherwise exhibit reduced energy absorption capability, and avoiding the risk of the honeycomb collapsing upwards in the event of an impact on the rim.

The rigid loop also provides a well-defined open state of the honeycomb structure, preventing insufficient opening or over-stretching of the structure. The end plates preferably open so as to spread the honeycomb protective structure through at least 180 degrees, and more preferably through at least 200 degrees. In some particularly preferred cases, the locking angle between the arcuate end plates when forming the rigid loop is in the range of 200-240 degrees, with certain particularly-preferred implementations having an angle of 220±10 degrees between the plates in their locked state forming a rigid loop.

It should be noted that the aforementioned opening of the structure to beyond 180 degrees provides a solution to an otherwise highly problematic issue when designing a folding helmet. Current safety standards for helmets require extensive coverage of the head of the user extending downwards from a horizontal midline of the head both at the back and at the sides. At the same time, the standards require that the line of sight of the user's eyes be unimpeded. In a molded helmet, these requirements can readily be satisfied by shaping a helmet extending suitably down around the head at the back and sides while providing a raised edge at the front. However, this cannot be readily achieved with a collapsible helmet. Any helmet which opens up to no more than 180 degrees (as is the prevalent conventional approach), thereby forming a roughly hemispherical form, will inherently be unable to provide the extent of coverage required at the back and sides of the head while leaving the line of sight unobstructed. The present invention, by opening up the honeycomb structure to in excess of 180 degrees, and most preferably around 220 degrees, manages to achieve extended coverage of the helmet down the sides of the head, well below a plane perpendicular to a plane of symmetry of the helmet and containing the axis of opening, without obstructing the line of sight of the user.

The engagement configurations for interconnecting the arcuate end plates can be any suitable engagement configurations. The two arcuate plates may be initially interconnected by a simple hinge, or by a compound hinge or other linkage, thereby at least partially defining a path of relative motion between the arcuate end plates during opening of the helmet from its collapsed state to its deployed state. Alternatively, as in the non-limiting implementation illustrated here, the two arcuate end plates may be detached from each other in the collapsed state (FIG. 1A). In this case, interlocking between the two arcuate end plates is typically performed manually by the user. The arcuate plates are referred to as such since they typically have a substantially planar surface facing the honeycomb structure, and can conveniently be implemented as relatively thin layers, for example, formed from rigid or semi-rigid polymer material. However, the plates are not limited to flat parallel-faced plates, and could be implemented with any desired shape, and/or implemented using thicker structures of material having significant additional impact-absorbing properties. The plates are "arcuate" in the sense that they have a curved profile, preferably matching to the arcuate profile of the honeycomb structure and extending beyond that structure to the attachment region where complementary parts 16*a* and 16*b* of the engagement configuration are deployed.

Figure 2A:
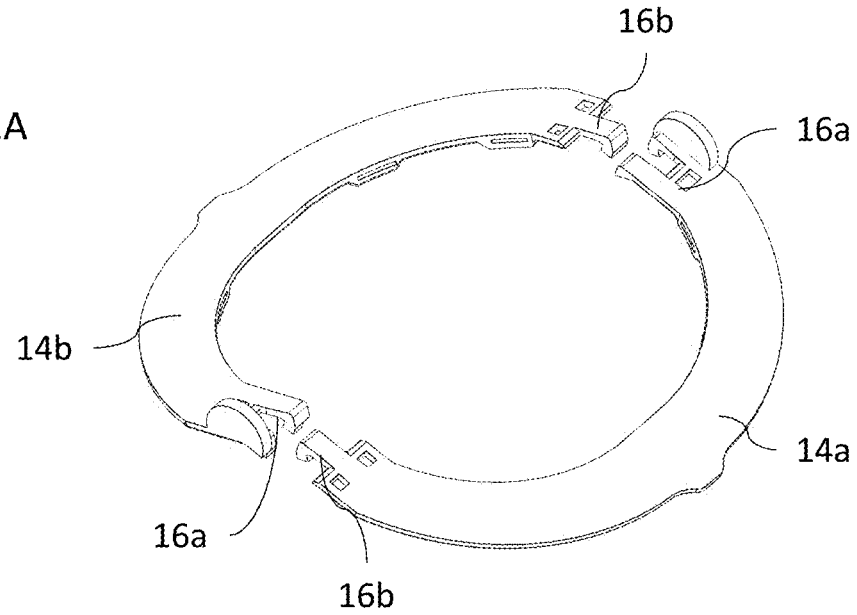
Figure 2B:
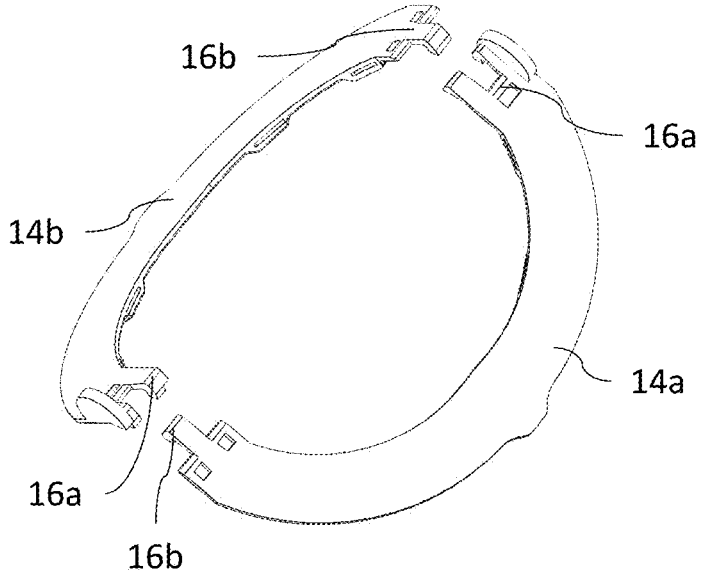
Figure 2C:
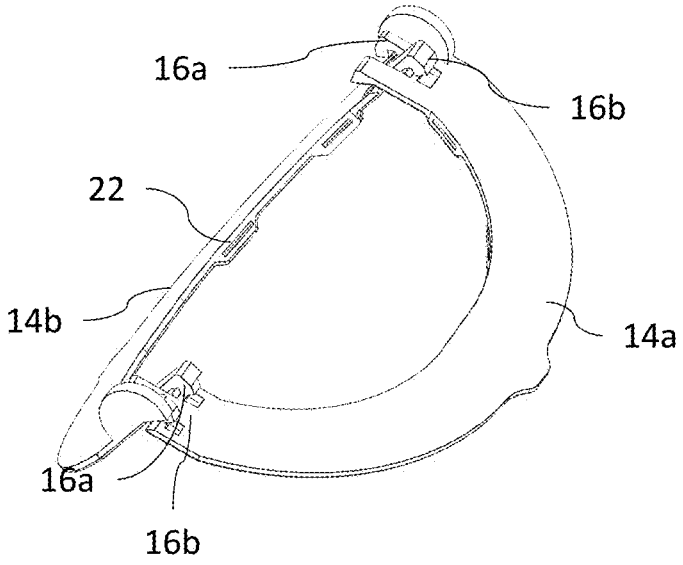

By way of one particularly preferred but non-limiting example, FIGS. 2A-2E illustrate a sequence of bringing together and interlocking two arcuate end plates from the collapsible helmet of FIGS. 1A and 1B, where the arcuate layered structure has been omitted to show the structure of the end plates more clearly. In this case, the engagement configurations are configured to allow engagement of the complementary parts 16*a* and 16*b* when the arcuate end plates are temporarily brought to an engagement angle which is greater than the locking angle (FIGS. 2B and 2C), and to lock together when the arcuate end plates to return from the engagement angle to the locking angle (FIGS. 2D and 2E). In use, resilient tension in the arcuate layered structure 12 (FIG. 1B) biases the arcuate end plates 14*a* and 14*b* to return from the engagement angle to the locking angle, thereby maintaining the rigid loop locked during use of the helmet. Locking and unlocking of the engagement of the arcuate end plates 14*a* and 14*b* is preferably achieved by manually stretching the arcuate layered structure 12 so as to momentarily reach the engagement angle, at which the end plates can readily be engaged or disengaged.

Figure 3A:
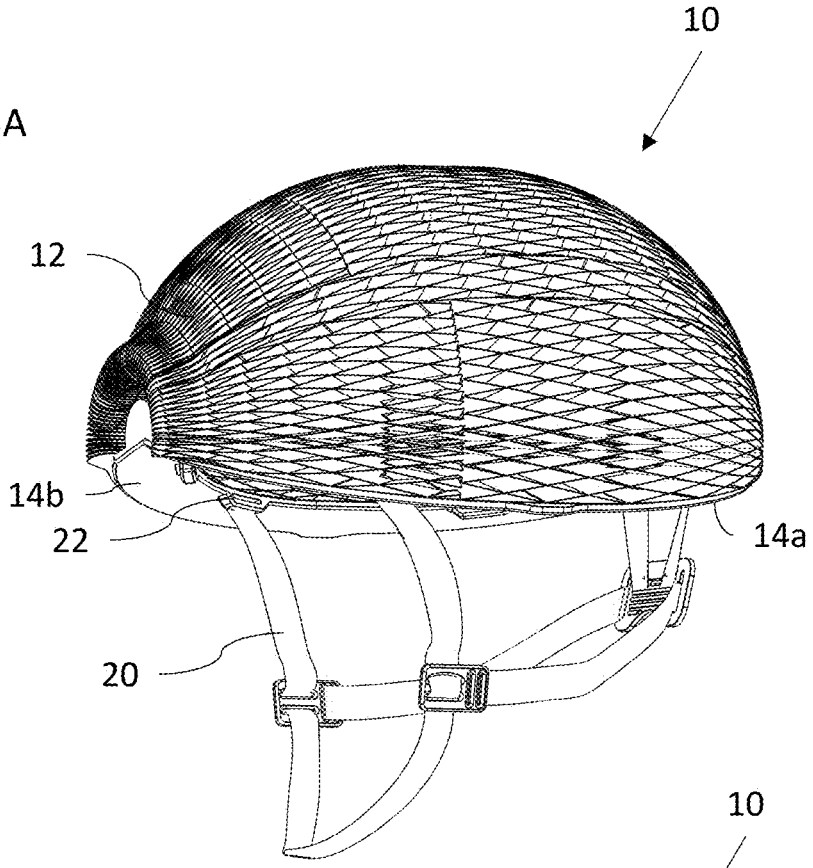
FIGS. 3A and 3B are isometric side views of a helmet according to the teachings of an embodiment of the present invention, shown alone and positioned on a user's head, respectively.
Figure 3B:
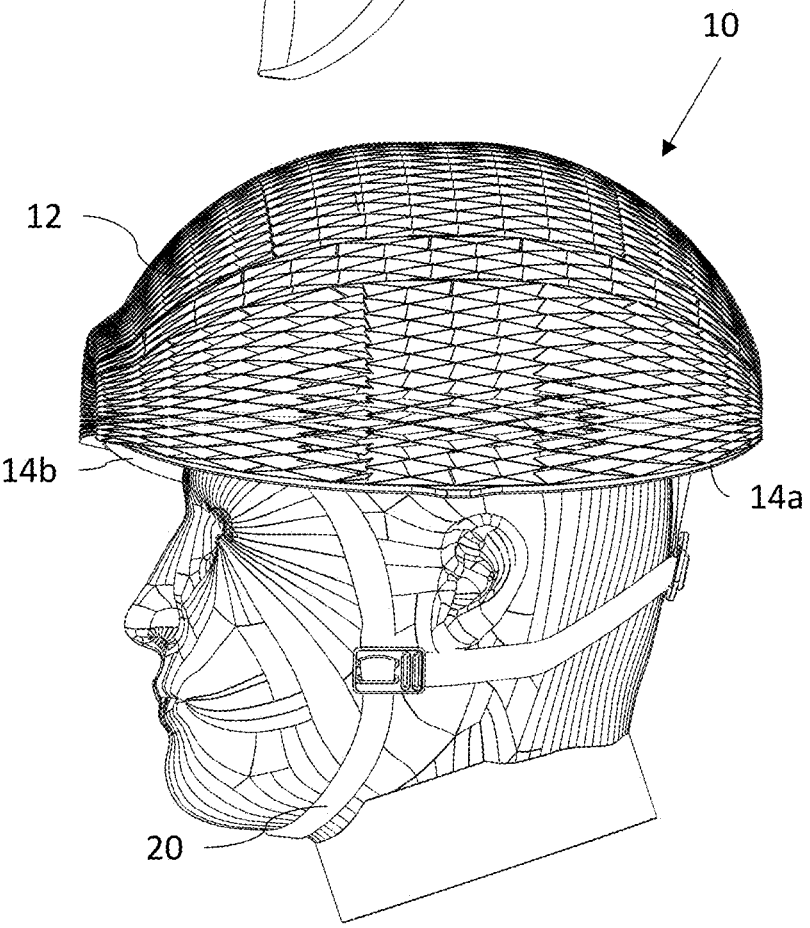

To complete the structure of the helmet for use, an arrangement of straps 20 is provided, as illustrated in FIGS. 3A and 3B, for fastening under the chin (fastener not shown) so as to hold the helmet correctly positioned on the head during use. The straps preferably attach to strap guides, such as dedicated eyelets 22, in the arcuate end plates 14*a* and 14*b* at least at four anchoring points, which are typically bilaterally near the temples and bilaterally near the rear of the helmet. The straps may terminate at their attachment locations to eyelets 22. More preferably, the straps may continue and form a closed harness which extends across the top of the user's head internally to the helmet, thereby reducing the risk of applying excess tension to over-extend the collapsible honeycomb structure. Details of an exemplary implementation of a strap harness according to an aspect of the present invention are provided below. Location of the straps internally to the honeycomb structure is preferable, ensuring that tension in the straps does not crush the honeycomb structure and compromise its energy absorption properties.

Strap Harness for Collapsible Helmets

Turning now to a second aspect of the present invention, efficacy of a protective helmet is dependent on maintaining correct positioning of the helmet on the head of the user, both during normal use and under conditions of an impact. This presents particular challenges in the context of a collapsible or other lightweight helmet, where the structure of the helmet typically cannot be relied upon to provide rigid anchoring points strong enough to withstand the forces occurring during use and/or during an impact. An aspect of the present invention provides a strap harness configuration which has been found effective to hold a collapsible helmet in position under a wide range of conditions and applied forces. The interface between the straps and the helmet is primarily at at least three, and preferably four, locations around or near the lower edge of the helmet rim, and preferably serves as a strap guide to maintain a desired spacing between the straps, but without relying on the helmet to directly oppose tension in the straps.

Figure 3C:
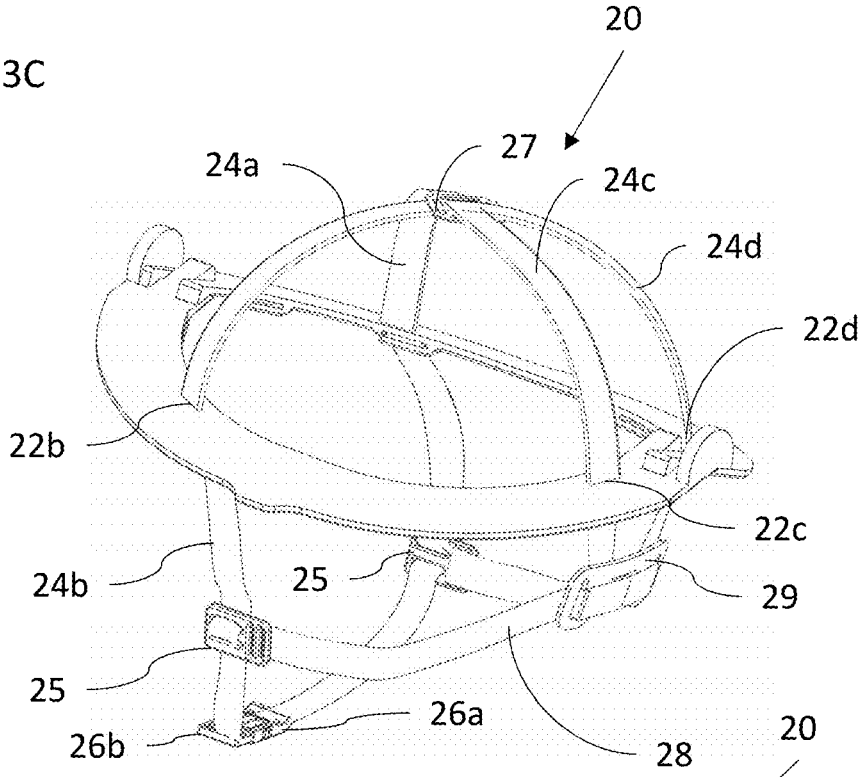
FIGS. 3C and 3D are isometric views of a strap harness of a helmet according to the teachings of an embodiment of the present invention with the protective dome structure removed, the strap harness being shown alone and positioned on a user's head, respectively.
Figure 3D:
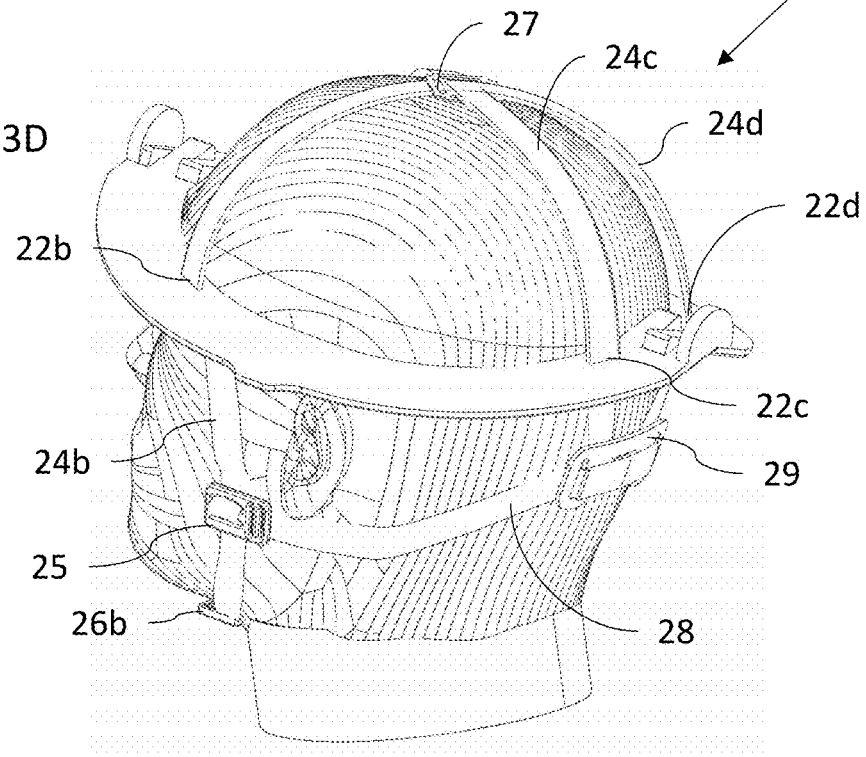

A particularly preferred form of the strap harness is illustrated in FIGS. 3C and 3D, with the honeycomb protective structure removed and showing only the locations of strap guides of the closed loop support structure. The use of a rigid loop structure for the lower edge of the helmet provides an additional safeguard against displacement of the strap harness from its intended positioning, but is not essential to this aspect of the invention, which can also be used to advantage with substantially any lightweight and/or collapsible helmet in which the helmet may be unable to provide rigid anchoring points for straps, whether based on honeycomb structures or other foldable, collapsible and/or lightweight structures.

According to this aspect of the present invention, a protective structure deployable as a dome (or "canopy") for fitting to an upper part of the head of the user is provided with strap guides located at regions of the dome corresponding to a right temple region 22*a*, a left temple region 22*b*, and at least one nape region 22*c* and 22*d*. The strap guides can be slots as illustrated here, or eyelets as illustrated above, or any other feature which prevents displacement of the straps around the periphery of the helmet dome. The anatomical references used to identify the above regions refer to the part of the lower edge of the dome (e.g., of the rigid loop) which lie closest to these anatomical features when the helmet is deployed on the head of the user, but it is appreciated that the features may lie either inside or outside the coverage of the helmet dome.

The protective structure is held in place on the head of the user by a strap harness configuration 20 which includes:

i. a first strap portion 24*a* extending from a first part 26*a* of a chin buckle via the right temple strap guide 22*a*, and traversing at least part of the dome of the protective structure, ii. a second strap portion 24*b* extending from a second part 26*b* of a chin buckle via the left temple strap guide 22*b*, and traversing at least part of the dome of the protective structure, iii. a rear retainer strap arrangement 28, interconnected with the first strap portion 24*a*, typically via a connector 25, between the first part 26*a* of the chin buckle and the right temple strap guide 22*a*, and interconnected with the second strap portion 24*b*, typically via a connector 25, between the second part 26*b* of the chin buckle and the left temple strap guide 22*b*. The rear retainer strap arrangement 28 is deployed to extend around a nape of a neck of the user, and iv. at least one rear tether 24*c* and 24*d*, attached to or integrally formed with at least one of the first and second strap portions 24*a* or 24*b*, extending from the dome via the at least one nape region strap guide 22*c* and 22*d* and interconnected with the rear retainer strap arrangement 28.

In one particularly preferred but non-limiting implementation, the at least one rear tether is implemented as a first tether 24*c* which is a continuation of the first strap portion 24*a* and extends via a left strap guide 22*c* of the at least one nape region strap guide, and a second tether 24*d* which is a continuation of the second strap portion 24*b* and extends via a right strap guide 22*d* of the at least one nape region strap guide. In this case, both the first tether and the second tether are interconnected with the rear retainer strap arrangement 28, either individually or via a common strap connector 27. In one particularly preferred implementation, first strap portion 24*a*, first tether 24*c*, second tether 24*d* and second strap portion 24*a* are parts of a single continuous strap (which crosses a sagittal plane as it passes between slots of the strap connector 27.

A clip 29 is preferably deployed to clip together the first strap portion 24*a* and the second strap portion 24*b* at a region of overlap within the dome, as illustrated in FIGS. 3C and 3D. The clip is advantageously anchored or tethered to the inside of the helmet dome. As discussed above, the strap harness described herein is particularly useful for helmet which do not have sufficient inherent rigidity to provide rigid anchoring points strong enough to withstand the forces occurring during use and/or during an impact. Since the strap harness described herein is independently stable on the head of the user, any anchoring of clip 29 does not need to withstand the full tension which may be applied to the straps, but rather only to bear the weight of the helmet itself in order to keep it correctly positioned relative to the harness.

As mentioned above, the strap harness configuration is most preferably deployed internally to the dome of the protective structure, thereby ensuring that tension in the straps does not crush the honeycomb (or other energy-absorbing) structure and compromise its energy absorption properties.

Honeycomb Structure

Turning now to a third aspect of the present invention, this relates to particularly preferred implementations of arcuate layered structure 12 which provides the required mechanical properties to protect the head of the user while being simple and low-cost to manufacture.

Figure 4:
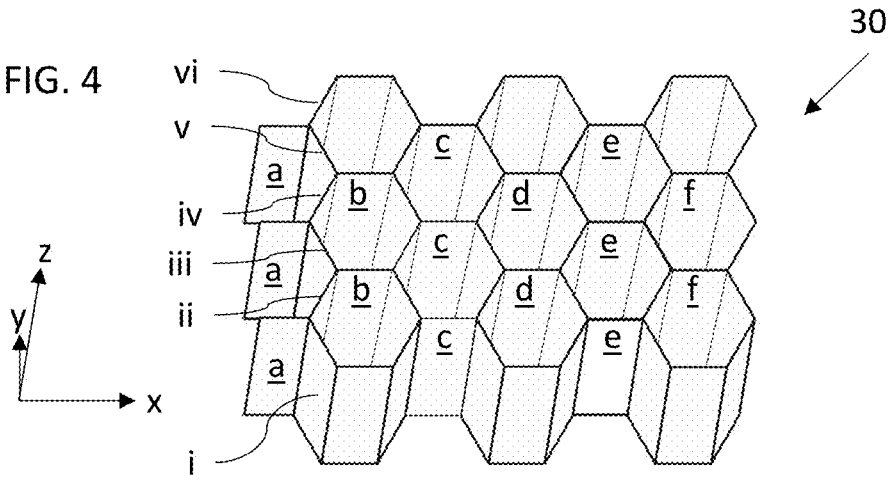
FIG. 4 is a schematic isometric illustration of a honeycomb energy-absorbing structure.

Referring to FIG. 4, it is noted that a honeycomb structure as referred to herein is a structure formed from plurality of layers 30, where each layer is joined to the adjacent layers along lines of attachment which are staggered between successive layers. Thus, in a simple example, if we consider a stack of layers numbered successively i, ii, iii, iv etc. and a sequence of lines/regions of attachment spaced along those layers labeled sequentially a, b, c, d, etc., a honeycomb structure could be formed by bonding odd-numbered layers i, iii, v to the successive even-numbered layers ii, iv, vi at alternate lines a, c, e, etc., and even layers ii, iv to the successive odd-numbered layers iii, v at the staggered alternate lines b, d, f. When the resulting structure is opened up, it forms a honeycomb structure as illustrated in FIG. 4.

The aforementioned lines of attachment may be wide lines, roughly equal in width to the spaces between lines, in which case the resulting open structure forms roughly hexagonal cells. Alternatively, relatively narrow lines of attachment can be used, in which case the resulting open structure forms cells which approximate to parallelograms. Furthermore, as discussed in certain variants below, the cells may be asymmetrical and/or non-uniform in size, the lines of attachment may be non-parallel, and the lines of attachment may be non-linear. All such cases and combinations thereof are still referred to herein generically as honeycomb structures.

The material of the layers may be any suitable material including, but not limited to, paper, cardboard or other cellulose-containing sheet material, and various polymer materials. In some cases, laminated or coated materials may be used, combining two or more compositions in each layer. The technique for attaching the lines of attachment can be any suitable technique chosen according to the properties of the layer material used. For cellulose-containing materials, various adhesive compositions may be used. For polymer materials, fusion by applying heat and/or pressure may be a suitable option.

The honeycomb structure has what is referred to herein as an "extensional cell direction." In the case of parallel lines of attachment (as in the example illustrated in FIG. 4), the extensional cell direction corresponds to the extensional direction of the lines of attachment, designated as the z-axis in FIG. 4. In any more complex case, the extensional cell direction can be defined more rigorously as a vector from centroid of an opening at the lower extremity of the honeycomb cell to a centroid of an opening at an upper extremity of the cell.

It will be noted that the honeycomb structure exemplified by FIG. 4 has highly anisotropic mechanical properties. An impact occurring parallel to the extensional cell direction results in progressive crumpling or other deformation of the cell walls, providing highly effective energy absorption. In contrast, forces applied in the x-y plane lead to changes in the cell geometry due to bending of the walls. Where the walls are made from flexible materials to allow the structure to be collapsible (as desired in our application), the structure has low resistance to deformation and little ability to absorb energy in the x-y plane.

The above-mentioned direction-dependence of honeycomb structure mechanical properties presents a challenge for implementation of a protective helmet using such structures. Specifically, the arcuate layered structure forming a protective helmet necessarily has an arcuate (curved) form spanning a range of angles around the head of the user, D. If such a structure is formed from a honeycomb construction with a uniform extensional cell direction (y axis in FIG. 4) across its entire area, it will be correctly oriented for impact protection for one region of the head, but other regions of the structure will present the extensional cell direction near-parallel to the local surface of the head, and will fail to provide effective impact protection.

A theoretically optimal solution would be to manufacture a specially-designed honeycomb structure for a helmet in which the lines of attachment would progressively tilt along the length of the helmet so as to be radially oriented at every location. "Radial" in this context refers to a direction perpendicular to the local surface of the head, typically approximated by a line perpendicular to a plane tangential to the inner surface of the helmet at that point. However, an implementation with continuously varying extensional direction of the honeycomb cells around the helmet would require complex dedicated production techniques which are typically unsuitable for scaling up to mass-production methods, and would raise production costs significantly compared to the use of conventional manufacturing processes for honeycomb structures with uniform extensional cell direction.

This issue is addressed by a third aspect of the present invention, which employs honeycomb layered structures with uniform extensional cell direction while ensuring that the orientation of the cells in all parts of the helmet is appropriate to achieve effective impact energy absorption. According to this third aspect of the present invention, a protective helmet includes an arcuate layered structure 12 assuming a collapsed state and openable into a honeycomb protective configuration for encompassing at least an upper part of the head. The arcuate layered structure spans an angular range from a first end 32 to a second end 34, which in this case correspond to the front and back extremities of the helmet. This arcuate range is typically at least 120° and more preferably at least 140°, and is defined by the angle turned through by the "radial direction" (as defined above) from adjacent to first end 32 to adjacent to second end 34, illustrated in FIGS. 5B and 9B as angle α. The term "arcuate" is used herein throughout the description and claims to refer to a structure which is curved with a non-reversing curvature so as to give an overall form which is intuitively perceived as arcuate. Typically, an optimal shape for the contour of a helmet is not in fact a pure arc of a circle (i.e., constant curvature), but rather has a relatively higher curvature (smaller radius of curvature) in the front and rear regions, and a relatively lower curvature (larger radius of curvature, or even a straight portion) in the center-top of the helmet, and may vary in other ways according to the desired closeness of fit and the physiology of the expected target population.

It is a particular feature of this aspect of the present invention that arcuate layered structure 12 is formed from a plurality of arcuate segments 36 each having an angular span less than the angular range a. Each segment 36 is formed from a plurality of layers joined to adjacent layers along lines of attachment, staggered between successive of the layers, so as to define, when opened, a honeycomb structure with an extensional cell direction. The extensional cell direction 38 is a radial direction for a mid-region of each of the arcuate segments, i.e., within a middle third of the angular span of the segment, and preferably substantially at the middle of a length of the segment.

Arcuate layered structure 12 is then assembled from at least two of the arcuate segments 36 deployed sequentially between first end 32 and second end 34 so that the extensional cell directions 38 approximate to radial directions of the arcuate layered structure 12 across the angular range a.

Figure 5A:
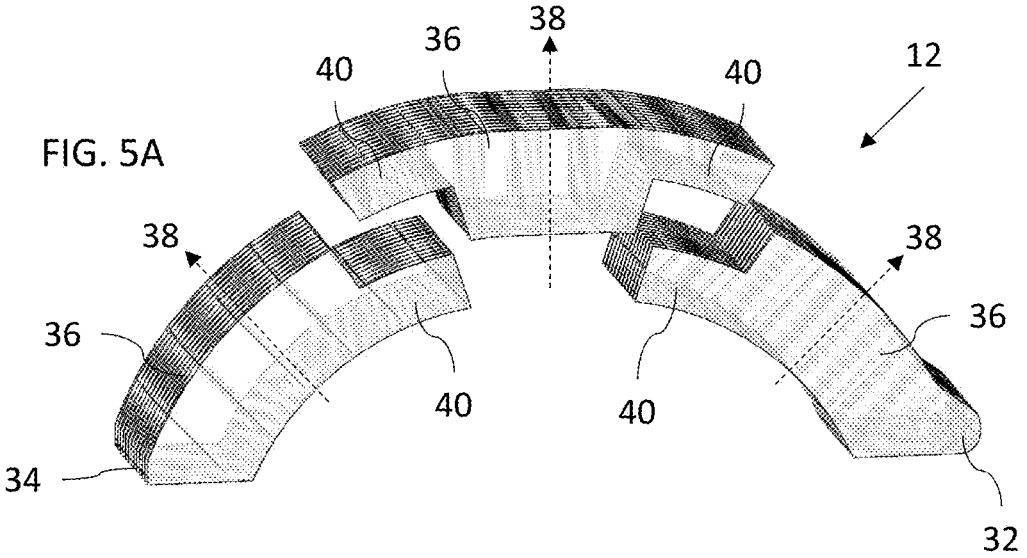
FIGS. 5A and 5B are isometric views of an arcuate layered structure for use in a helmet according to an embodiment of the present invention, the arcuate layered structure being formed from a number of segments, shown prior to and after assembly, respectively.

The significance and advantages of this aspect of the present invention can be better understood with reference to FIGS. 5A-10. Specifically, as shown schematically in FIG. 6, the various arcuate segments 36 can be cut from a stack of layers bonded so as to form a honeycomb structure with a uniform extensional cell direction, indicated by arrow 38, with the orientation of each arcuate segment chosen so that the extensional cell direction is radial for a mid-region of the segment. Then, when the helmet is assembled, each segment is deployed in the appropriate orientation as seen in FIGS. 5A and 5B. The extensional cell direction in all parts of the helmet is then relatively close to the local radial direction to provide effective energy absorption for a radial impact.

To illustrate this numerically, if we consider an angular range of 120 degrees between the front and back ends of the arcuate layered structure, if a vertical extensional cell direction was used for the entire helmet, the extreme front and back of the helmet would have an extensional cell direction misaligned by 60 degrees to the local radial direction, resulting in greatly reduced effectiveness of the honeycomb structure for impact energy absorption. In contrast, according to the three-segment implementation of FIGS. 5A and 5B, the front and back segments may be deployed with extensional cell directions at, for example, roughly ±40 degrees relative to the central segment, resulting in a maximum misalignment between the extensional cell direction and the local radial direction of no more than about 20 degrees, which ensures that the impact energy absorption properties of the honeycomb structure are near-optimum. Similarly, FIGS. 8A-9B illustrate implementations in which only two arcuate segments are used to cover the angular range. Even here, for an angular range of 120 degrees, if the two segments are implemented with an extensional cell direction which is at ±30 degrees to the bisector of the angular range, the maximum misalignment between the extensional cell direction and the local radial direction will be no more than about 30 degrees, which is sufficiently small to ensure that a majority of the radial impact absorption properties of the honeycomb structure are preserved. Typically, misalignment angles of up to about 35 degrees, in some cases up to about 40 degrees, and in certain cases up to about 45 degrees, have been found to provide adequate preservation of the energy absorption properties of the honeycomb structure under radial impact. Subdivision of the angular range into more than three segments, such as four or five segments, can also be used.

Figure 10:
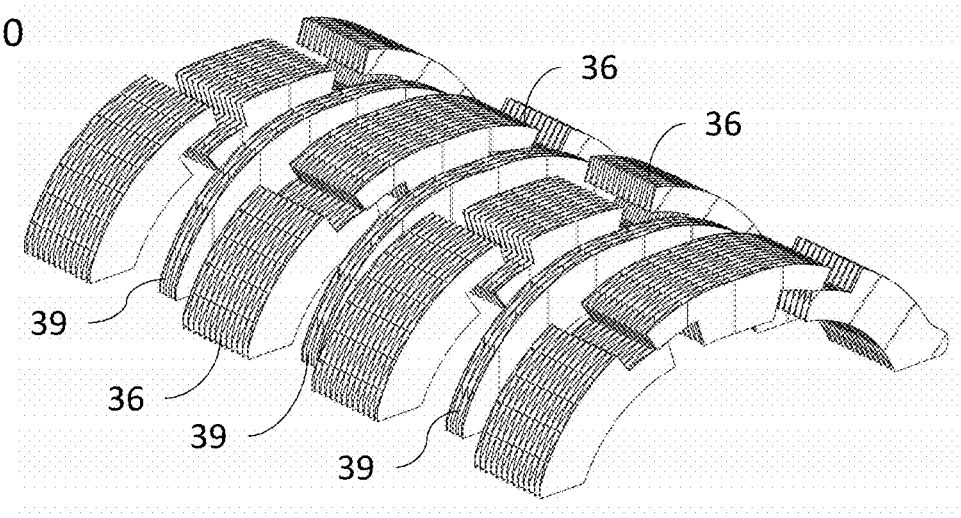
FIG. 10 is a schematic isometric view of an arcuate layered structure being assembled from sets of segments as illustrated in FIG. 7 with interposed full-length sections of honeycomb layered material.

Additionally, in some cases, it may be effective to construct a helmet from a combination of segments which cover different angular ranges, such as alternating sets of two segments with sets of three segments, such that the joints between the segments lie in different locations, thereby adding to the mechanical strength of the entire assembly. In some cases, as illustrated in FIG. 10, a relatively thin section of a full-angular-range arcuate portion of honeycomb material 39 may be interposed between the sets of segments 36, i.e., extending continuously from the front to the back of the arcuate honeycomb structure. Although the full-angular-range arcuate portion (e.g., with a vertical segment extension direction along its entire length) suffers from the aforementioned non-optimal contribution to the energy absorption properties towards the extremities of the helmet, it provides alternative mechanical advantages of unifying the entire structure and facilitating assembly. If the full-length section is relatively thin compared to the multi-segment parts, the overall mechanical properties are typically preserved or even enhanced. In one particularly preferred but non-limiting example, a full-length section of a first number of layers is interposed with multi-segment sections of at least 3 times more layers. In one example, each full-length section is a honeycomb material formed from 6 layers of sheet material while each section of plural segments contains segments formed from 24 layers of sheet material.

In view of the construction of the protective canopy of the helmet from a plurality of segments, precautions are preferably taken to ensure that the region where the segments meet provides adequate protection against penetration of an impacting object or edge. Precautions are particularly needed in this area in view of the tendency of honeycomb structures to shorten their dimensions in the direction of the layers when the structures are opened up (although this shortening effect is preferably greatly limited by the use of honeycomb structures which are only opened to relatively small angles, as illustrated in FIGS. 1B and 3A-3B).

Figure 5B:
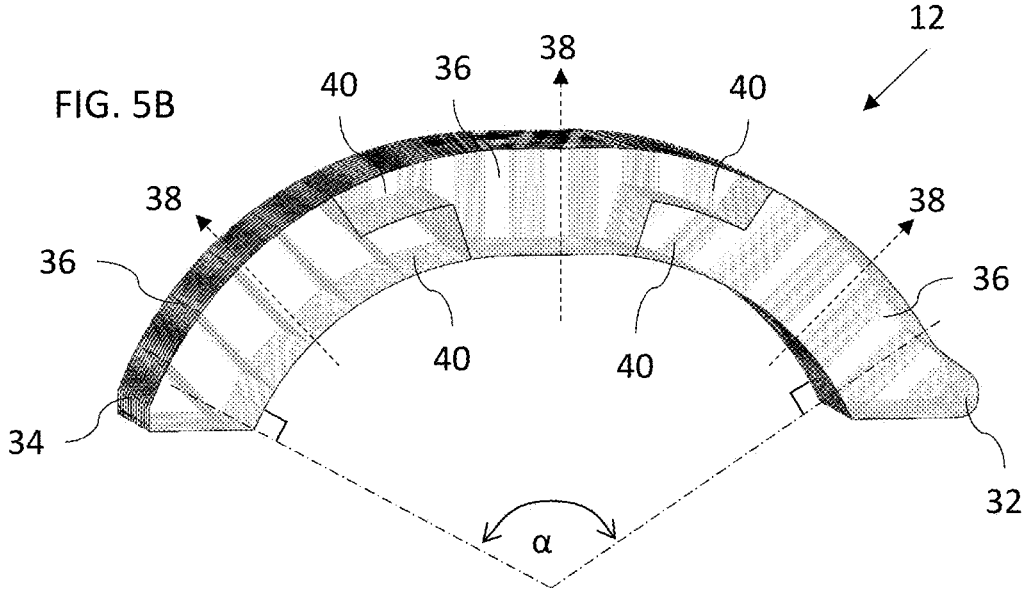

Enhanced protection at the junctions between the segments is preferably provided by forming adjacent of the arcuate segments with complementary overlap regions 40. Each overlap region has a thickness that is less than the overall helmet thickness, but is configured to be deployed in overlapping relation with the complementary overlap region of the adjacent segment, thereby providing a combined thickness that is greater than the thickness of each of the overlap regions individually, and preferably adds up to an overall thickness similar to the thickness of the helmet in other regions. In the example of FIGS. 5A and 5B, the overlap regions 40 are formed as a step-down in thickness, with each overlap region corresponding to, for example, roughly half of the overall thickness of the arcuate layered structure, one corresponding to the inner half and the other corresponding to the outer half. Proportions of thickness other than half-half are also possible.

Figure 9A:
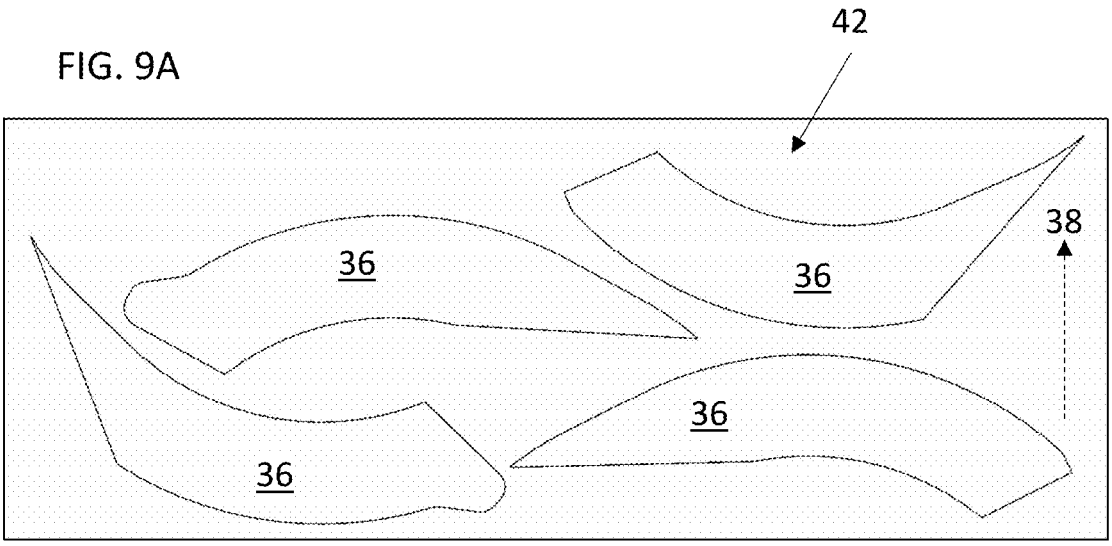
FIG. 9A is a view similar to FIG. 6 illustrating an alternative segment structure with two segments per set of segments spanning the angular range of the helmet and employing tapered regions of overlap between the segments.
Figure 9B:
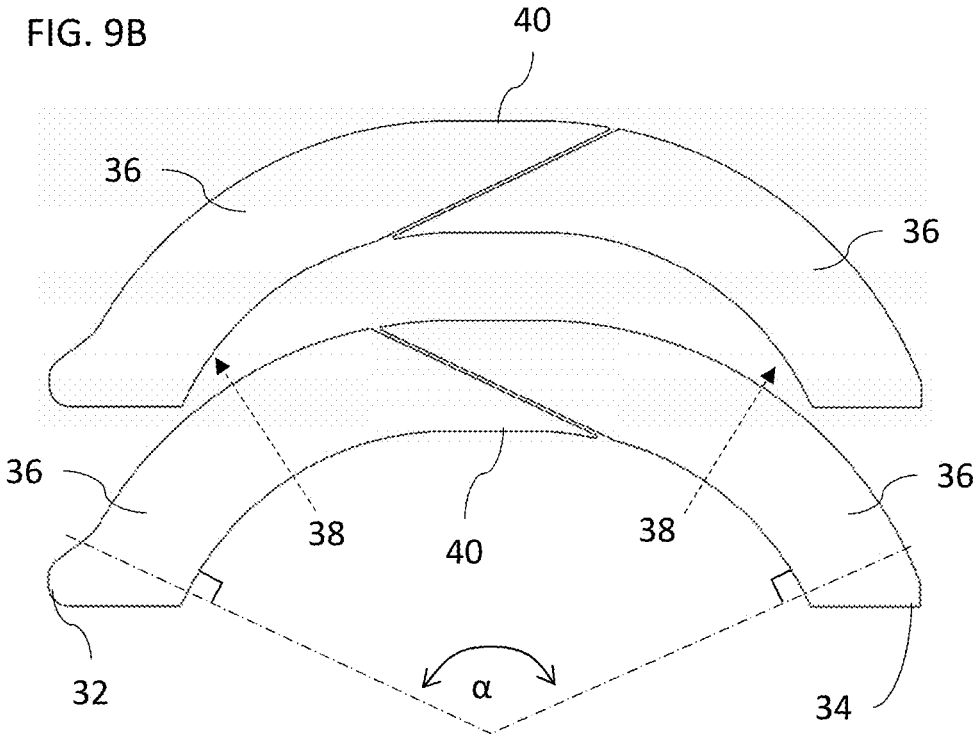
FIG. 9B is a schematic view of two sets of arcuate segments cut from a stack according to the layout of FIG. 9A being assembled to form a helmet according to an embodiment of the present invention with tapered regions of overlap between the segments.

In other implementations, exemplified by FIGS. 9A and 9B, the thickness of each complementary overlap region 40 is tapered, i.e., forming a wedge shape which gradually reduces from the full thickness of the helmet down to a narrow edge. In certain cases, this tapered option may be preferred over the step-down thickness option, since any reduction in overlap with result in a relatively small reduction in the overall thickness distributed over the length of the overlap region, thereby avoiding any partial gaps with only 50% thickness coverage, as could potentially occur with the step-down thickness approach. Other forms of overlap region can also be used, such as step-down thickness with two or more steps (changes in thickness), or a combination of a small step-down in thickness followed by a taper extending to a further small step-down. This latter option preserves most of the advantages of the tapered form while avoiding the need to cut the honeycomb structure down to a thin edge, which might lack sufficient structural stability.

In order to avoid interfering with the opening-up of the honeycomb structure in the overlap region, the layered structures are preferably not directly attached to each other in the region of overlap. Instead, the relative positions of the arcuate segments are preferably secured by attaching the outermost layers of the segments to lamination layers which extend across the overlap regions and attach to both adjacent segments. In some cases, this may be a dedicated lamination layer corresponding to the entire shape of the arcuate layered structure 12. In other cases, an equivalent effect can be achieved by attaching the outer layers of one set of segments directly to the outer layers of an overlaid set of segments by arranging the locations and/or configuration of the regions of overlap to be out of alignment between the different sets of segments.

Figure 7:
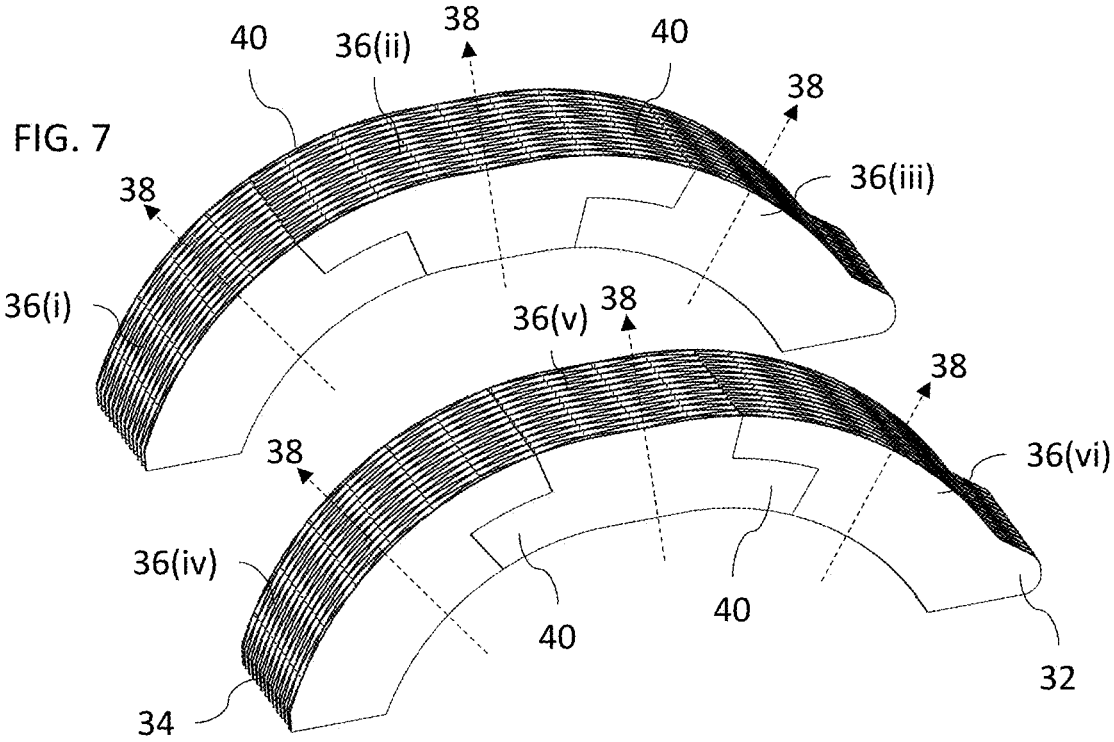
FIG. 7 is an isometric view of two sets of arcuate segments being assembled to form a helmet according to an embodiment of the present invention.

A non-limiting example of this approach is illustrated in FIG. 7. Specifically, there are shown components of an arcuate layered structure 12 including a first plurality of the arcuate segments 36(*i*), 36(*ii*), 36(*iii*), spanning the angular range from the first end 32 to the second end 34 and a second plurality of the arcuate segments 36(*iv*), 36(*v*), 36(*vi*), spanning the angular range from first end 32 to second end 34. The second plurality of the arcuate segments 36(*iv*), 36(*v*), 36(*vi*) are bonded to the first plurality of the arcuate segments 36(*i*), 36(*ii*), 36(*iii*) such that each of the first and second pluralities of the arcuate segments provides a part of an overall width of the honeycomb protective configuration. The overlap regions 38 of the first plurality of the arcuate segments do not coincide with the overlap regions of the second plurality of the arcuate segments, so that bonding together of the two sets of segments also serves to unify the sets of segments across the overlap regions. "Not coinciding" in this context means that any potential lines of separation between the adjacent arcuate segments of one set of segments are not aligned with potential lines of separation in the overlying set of segments. This is typically ensured either by locating the regions of overlap at different angular positions around the helmet or by reversing the overlap configurations. In the example illustrated here, the overlap configurations are reversed, with arcuate segments 36(*i*), 36(*iii*) and 36(*v*) (both sides) having overlap regions corresponding to the inner half of the helmet thickness, while arcuate segments 36(*ii*) (both sides), 36(*iv*) and 36(*vi*) have overlap regions corresponding to the outer half of the helmet thickness. When these two structures are stuck together, overlap of the outer adhered layers of arcuate segments 36(*ii*), 36(*iv*) and 36(*vi*) in the outer half of the helmet thickness, and of arcuate segments 36(*i*), 36(*iii*) and 36(*v*) in the inner half of the helmet thickness, ensures that the segments are reliably secured so as not to become separated. This type of interconnection is preferably repeated for multiple sets of overlaid segments to construct the total desired width of the helmet, each interface adding to the structural strength of the interconnection between the segments.

Figure 6:
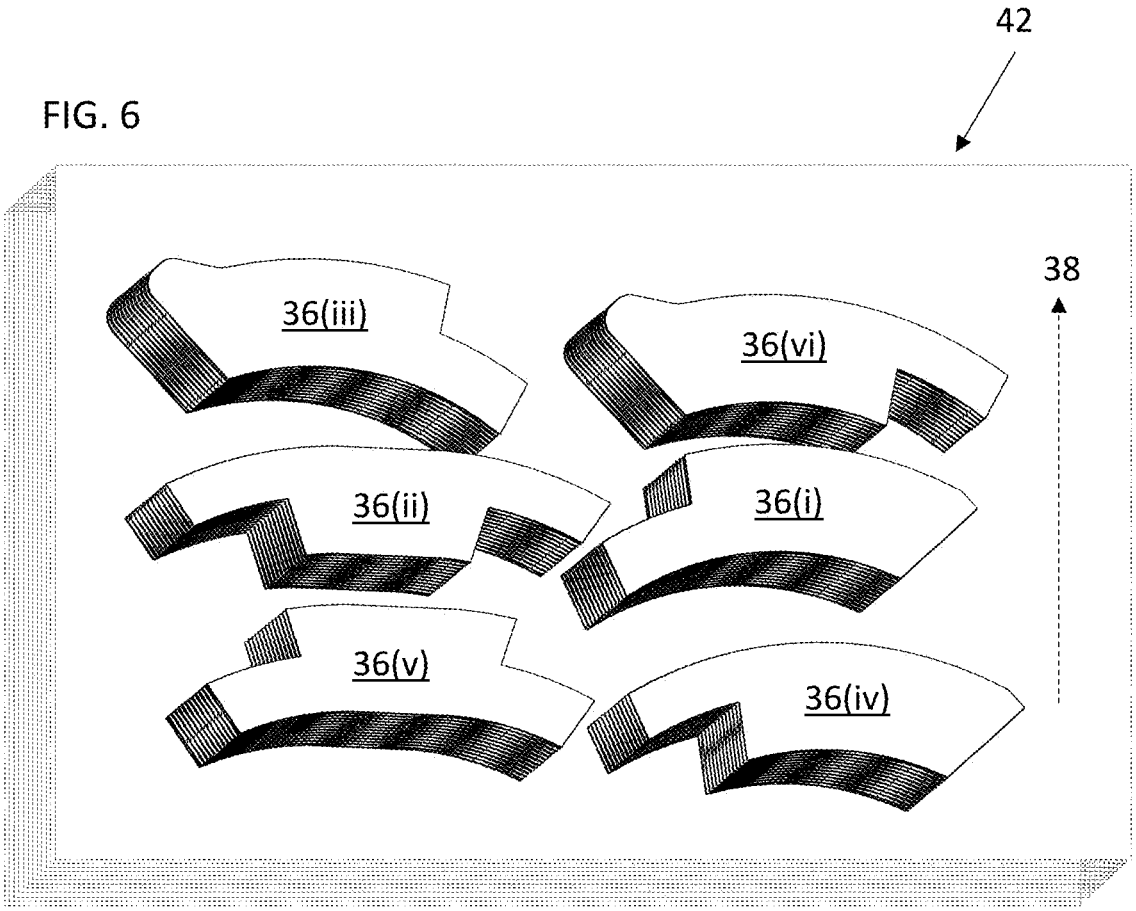
FIG. 6 is a schematic illustration of sets of arcuate segments being cut from a stack of a honeycomb-forming layered structure.
Figure 8A:
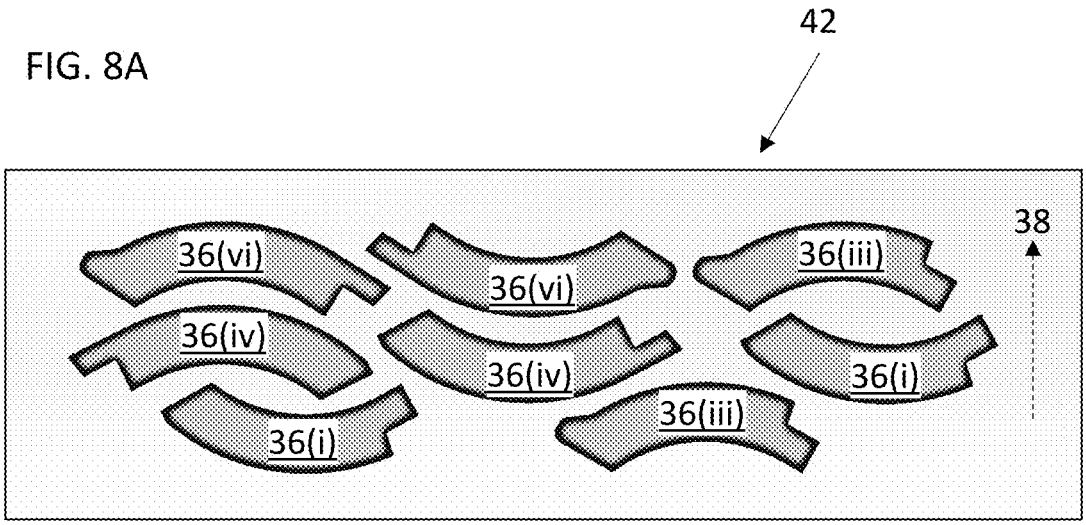
FIG. 8A is a view similar to FIG. 6 illustrating an alternative segment structure with two segments per set of segments spanning the angular range of the helmet.
Figure 8B:
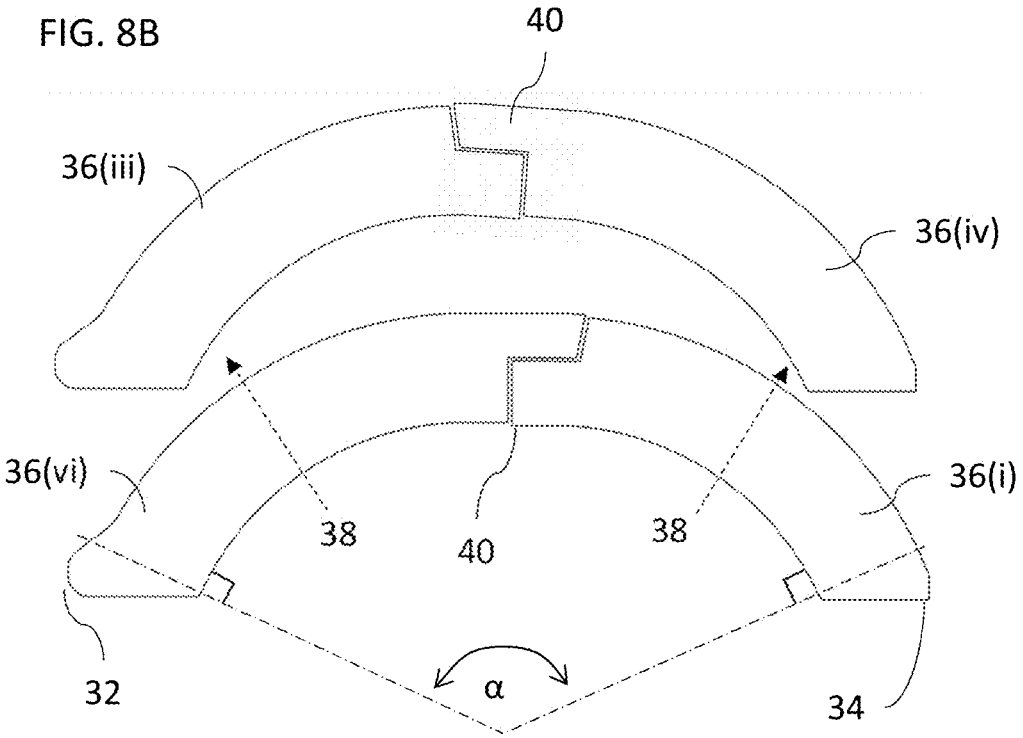
FIG. 8B is a schematic view of two sets of arcuate segments cut from a stack according to the layout of FIG. 8A being assembled to form a helmet according to an embodiment of the present invention.

FIG. 6 illustrates that the 6 types of segments, 36(*i*), 36(*ii*), 36(*iii*), 36(*iv*), 36(*v*) and 36(*vi*), can all be cut conveniently from a single block (alternatively referred to as a "stack", or in its flattened state, a "sheet") 42 of layered material interconnected to define a honeycomb structure with a uniform extensional cell direction 38. FIGS. 8A and 8B are similar illustrations relating to a construction with two arcuate segments 36(*i*) and 36(*vi*), or 36(*iii*) and 36(*iv*), in each set spanning the angular range of the helmet, and providing, for example, four sets of such segments with alternating inner/outer half overlap regions between sets from a single block 42 of honeycomb material.

Thus, this aspect of the present invention also provides a method for producing a collapsible helmet including steps of:

a) providing a sheet (block) of a laminate structure formed from layers joined to adjacent layers along staggered lines of attachment to as to define, when opened, a honeycomb structure with parallel extensional cell directions;

b) cutting from the sheet a plurality of arcuate segments, each of the arcuate segments being oriented relative to the uniform extensional cell direction so that the extensional cell direction is radial relative to a mid-region of the arcuate segment; and c) assembling the arcuate segments in juxtaposed relation to form an arcuate layered structure in which the extensional cell directions of the arcuate segments are non-parallel.

The features of this aspect of the present invention are believed to be broadly applicable to any and all protective helmets formed from honeycomb material, independent of the closed-loop support structure features described above. However, a particularly preferred implementation of the present invention employs such honeycomb assemblies integrated between end plates as disclosed above, resulting in a helmet structure as illustrated in FIGS. 3A and 3B, above.

Variant Honeycomb Constructions

As an addition, or an alternative, to the various features of a collapsible helmet described above, certain embodiments of the collapsible helmet of the present invention employ a modified honeycomb construction, where the energy absorbing properties of the honeycomb structure are modified.

Figure 11A:
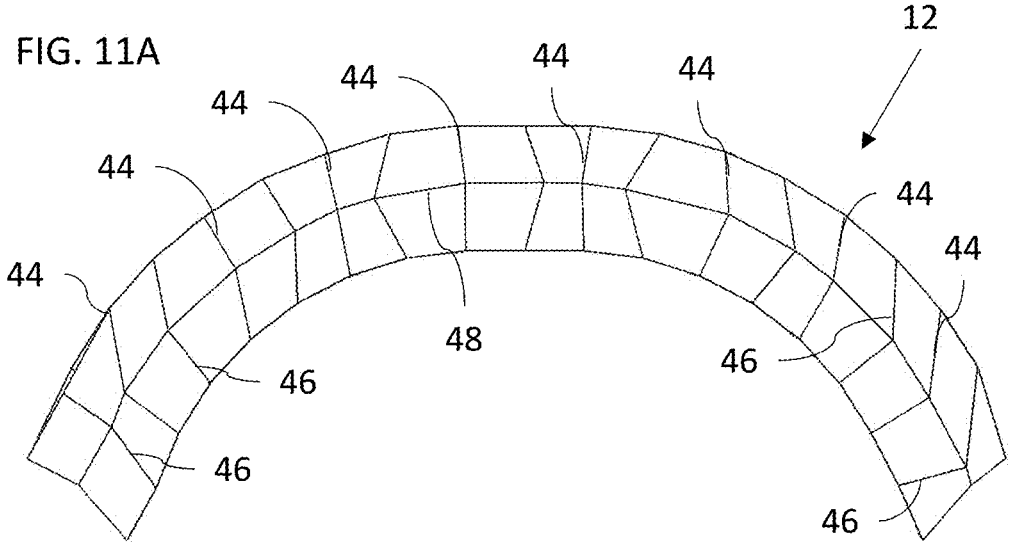
FIGS. 11A and 11B are schematic isometric views illustrating a modified honeycomb structure formed by bonding together layers along non-linear lines of attachment, the structure being shown in a flat (collapsed) and deployed (open) state, respectively.
Figure 11B:
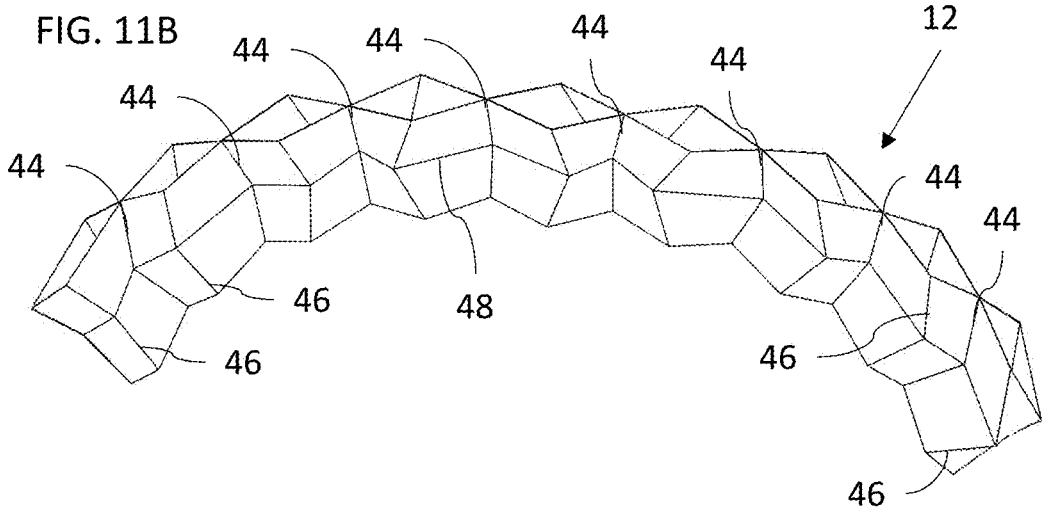

In a first example, illustrated in FIGS. 11A and 11B, part or all of an arcuate layered structure 12 forming a honeycomb when opened is formed by attaching adjacent layers of the structure along staggered lines of attachment which are non-straight lines 44. "Non-straight" in this context refers to any form other than a single straight line. The non-straight lines may advantageously be made up from two non-colinear straight line segments, as shown in the illustrated example. The non-straight radial lines of connection 46 are the lines which would be attached to the subsequent adjacent layer of a multi-layer structure (not shown). This results, when opened, in a three-dimensional structure with additional curvature or fold-lines 48 as shown in FIG. 111B, where energy absorption is not limited to crushing of the cell walls, and can additionally occur through other geometrical deformations which apply tension or compression to parts of the cell walls, resulting in additional mechanisms of energy dissipation in addition to the normal crushing action of an impact on a honeycomb structure. This provides an additional degree of design freedom, allowing, for example, enhancement of the energy absorption properties of the honeycomb at off-axis directions.

Although illustrated here in a case of non-straight lines made up of two linear line segments, other non-straight lines, such as various curved lines of attachment, may also be used.

It will be appreciated that the above descriptions are intended only to serve as examples, and that many other embodiments are possible within the scope of the present invention as defined in the appended claims.

What is claimed is:

1. A collapsible helmet deployable for protecting a head of a user, the helmet comprising:

an arcuate layered structure configured to have a collapsed state and openable therefrom into a honeycomb protective configuration for encompassing at least an upper part of the head, said arcuate layered structure spanning an angular range from a first end to a second end in both said collapsed state and in said protective configuration, said arcuate layered structure being formed at least in part from a plurality of arcuate segments each having an angular span less than said angular range, each segment having a plurality of layers, each of said layers being joined to adjacent layers along lines of attachment, said lines of attachment being staggered between successive of said layers so as to define, when opened, a honeycomb structure with an extensional cell direction, said extensional cell direction being a radial direction for a mid-region of each of said arcuate segments, said arcuate layered structure including at least two of said arcuate segments deployed sequentially between said first end and said second end so that said extensional cell directions form an angle of no more than 45 degrees to radial directions of said arcuate layered structure across said angular range, wherein said arcuate layered structure has a helmet thickness in the radial direction, and wherein adjacent of said arcuate segments are formed with complementary overlap regions, each of said overlap regions having a thickness less than said helmet thickness, said complementary overlap regions being deployed in overlapping relation so as to provide a combined thickness greater than said thickness of each of said overlap regions.

2. The collapsible helmet of claim 1, wherein said thickness of each of said complementary overlap regions is tapered.

3. The collapsible helmet of claim 1, wherein said arcuate layered structure comprises a first plurality of said arcuate segments spanning said angular range from said first end to said second end and a second plurality of said arcuate segments spanning said angular range from said first end to said second end, said second plurality of said arcuate segments being bonded to said first plurality of said arcuate segments such that each of said first and second pluralities of said arcuate segments provides a part of an overall width of said honeycomb protective configuration, and wherein said overlap regions of said first plurality of said arcuate segments do not coincide with said overlap regions of said second plurality of said arcuate segments.

4. The collapsible helmet of claim 1, wherein said at least two arcuate segments are deployed so that said extensional cell directions form an angle of no more than 40 degrees to radial directions of said arcuate layered structure across said angular range.

5. The collapsible helmet of claim 1, wherein said at least two arcuate segments are deployed so that said extensional cell directions form an angle of no more than 35 degrees to radial directions of said arcuate layered structure across said angular range.

6. The collapsible helmet of claim 1, wherein said at least two arcuate segments include at least three arcuate segments deployed sequentially between said first end and said second end so that said extensional cell directions form an angle of no more than 30 degrees to radial directions of said arcuate layered structure across said angular range.

7. The collapsible helmet of claim 1, wherein said arcuate layered structure includes a first set of at least two of said arcuate segments deployed sequentially between said first end and said second end and a second set of at least three of said arcuate segments deployed sequentially between said first end and said second end, said first set of arcuate segments and said second set of arcuate segments being deployed in overlapping relation so that joints between adjacent arcuate segments of said second set are staggered relative to joints between adjacent arcuate segments of said first set.

8. A collapsible helmet deployable for protecting a head of a user, the helmet comprising:

an arcuate layered structure configured to have a collapsed state and openable therefrom into a honeycomb protective configuration for encompassing at least an upper part of the head, said arcuate layered structure spanning an angular range from a first end to a second end in both said collapsed state and in said protective configuration, said arcuate layered structure being formed at least in part from a plurality of arcuate segments each having an angular span less than said angular range, each segment having a plurality of layers, each of said layers being joined to adjacent layers along lines of attachment, said lines of attachment being staggered between successive of said layers so as to define, when opened, a honeycomb structure with an extensional cell direction, said extensional cell direction being a radial direction for a mid-region of each of said arcuate segments, said arcuate layered structure including at least two of said arcuate segments deployed sequentially between said first end and said second end so that said extensional cell directions form an angle of no more than 45 degrees to radial directions of said arcuate layered structure across said angular range;

a pair of arcuate end plates bonded to outer surfaces of said arcuate layered structure, opposite ends of each of said arcuate end plates carrying complementary parts of an engagement configuration, wherein, in a collapsed stated of the helmet, said arcuate end plates are brought together with said arcuate layered structure between them, and wherein, when said honeycomb structure is open, said engagement configurations at ends of said arcuate end plates engage so that said arcuate end plates form a rigid loop encircling a bottom edge of the helmet, wherein, in said rigid loop, said arcuate end plates form a locking angle between them greater than 180 degrees around which said honeycomb structure is stretched.

9. The collapsible helmet of claim 8, wherein said engagement configurations are configured to allow engagement of said complementary parts of said engagement configurations when said arcuate end plates are temporarily brought to an engagement angle which is greater than said locking angle, and wherein resilient tension in said honeycomb structure biases said arcuate end plates to return from said engagement angle to said locking angle.

10. A collapsible helmet deployable for protecting a head of a user, the helmet comprising:

an arcuate layered structure openable into a honeycomb protective configuration for encompassing at least an upper part of the head, said arcuate layered structure being formed from layers joined to adjacent layers along staggered lines of attachment so as to define, when opened, a honeycomb structure; and a pair of arcuate end plates bonded to outer surfaces of said arcuate layered structure, opposite ends of each of said arcuate end plates carrying complementary parts of an engagement configuration, wherein, in a collapsed stated of the helmet, said arcuate end plates are brought together with said arcuate layered structure between them, and wherein, when said honeycomb structure is open, each said engagement configurations at ends of said arcuate end plates engages so that said arcuate end plates form a rigid loop encircling a bottom edge of the helmet.

11. The collapsible helmet of claim 10, wherein, in said rigid loop, said arcuate end plates form a locking angle between them greater than 180 degrees around which said honeycomb structure is stretched.

12. The collapsible helmet of claim 11, wherein said engagement configurations are configured to allow engagement of said complementary parts of said engagement configurations when said arcuate end plates are temporarily brought to an engagement angle which is greater than said locking angle, and wherein resilient tension in said honeycomb structure biases said arcuate end plates to return from said engagement angle to said locking angle.

* * * * *